US005926094A

United States Patent [19]

Mamou

[11] Patent Number: 5,926,094

[45] Date of Patent: Jul. 20, 1999

[54] ANTITHEFT LABEL AND PROCESS FOR ITS DEACTIVATION, IN PARTICULAR FOR CLOTHING ARTICLES

[76] Inventor: Patrick Mamou, 8 Quai du Mesnil, F-94210 La Varenne Saint Hilaire, France

[21] Appl. No.: 08/849,026

[22] PCT Filed: Nov. 28, 1995

[86] PCT No.: PCT/FR95/01565

§ 371 Date: Jul. 28, 1997

§ 102(e) Date: Jul. 28, 1997

[87] PCT Pub. No.: WO96/17332

PCT Pub. Date: Jun. 6, 1996

[30] Foreign Application Priority Data

Nov. 28, 1994 [FR] France ..... 94 14226

[51] Int. Cl.[6] ..... G08B 13/00

[52] U.S. Cl. ..... 340/572.3; 340/501; 340/572.1

[58] Field of Search ..... 340/572, 551, 340/693, 501

[56] References Cited

U.S. PATENT DOCUMENTS

| | | | |
|---|---|---|---|
| 4,603,326 | 7/1986 | Freed | 340/572 |
| 4,835,524 | 5/1989 | Lamond et al. | 340/572 |
| 5,012,225 | 4/1991 | Gill | 340/572 |
| 5,574,431 | 11/1996 | McKeown et al. | 340/572 |

FOREIGN PATENT DOCUMENTS

| | | |
|---|---|---|
| 0594324 | 4/1994 | European Pat. Off. . |
| 2700617 | 7/1994 | France . |
| 4235042 | 4/1994 | Germany . |
| 656472 | 6/1986 | Switzerland . |
| 9109388 | 6/1991 | WIPO . |

*Primary Examiner*—Glen Swann
*Attorney, Agent, or Firm*—Greer, Burns & Crain, Ltd.

[57] ABSTRACT

A deactivation method for an antitheft adhesive label used with clothes and the like is disclosed. The method involves applying mechanical pressure on the label to release gel in the anti-theft device, thus modifying its physical characteristics and deactivating the device.

25 Claims, 1 Drawing Sheet

ANTITHEFT LABEL AND PROCESS FOR ITS DEACTIVATION, IN PARTICULAR FOR CLOTHING ARTICLES

The present invention relates to processes for neutralizing an antitheft device of the type which operates by influencing a detector placed for example at the exit of a store.

The present invention also relates to an antitheft device suitable for implementing the above processes.

The invention further relates to an article, in particular of clothing or similar, carrying such antitheft device operating by influence.

BACKGROUND OF THE INVENTION

For the protection of articles, in particular of clothing, from theft in retail stores, it is known to fix an antitheft device to each article. If a person attempts to take the clothing article away fraudulently, the antitheft device influences a detector placed in an alarm gate installed at the store's exit. To avoid the alarm going off when an honest customer leaves the store, there are several processes according to the type of influence means housed in the device.

If the antitheft device is designed in the form of a badge, the store staff must remove the device before the customer passes through the alarm gate. The retailer must therefore have a stock of badges, attach the badges before putting them on sale, and remove the badges each time a sale is made. This is very restricting.

According to DE-A-32 12 039, an antitheft influence device is known, being presented in the form of a thin label with an oscillating coil circuit, which can be used to equip numerous articles, books, clothing articles, etc. To neutralize the label, the document proposes cutting or punching or piercing part of the label in order to destroy the electrical conductors.

When the thin oscillating circuit label is not accessible for direct destruction, its neutralization will prove impossible to carry out.

Document CH-A-656 472 describes an antitheft label comprising a pre-cut portion. To neutralize the label, the pre-cut portion is removed, this portion containing part of the circuit forming the coil. In practice, this label did not give satisfaction as dishonest customers can easily understand, from the presence of the pre-cut dotted lines, the method used to neutralize the label, and can therefore use this method themselves before going through the alarm gate.

Document EP-A-0 209 916 discloses a process for neutralizing the same thin oscillating circuits. The coil is placed in a magnetic field sufficiently intense to allow the induced current flowing in the coil to trip a neutralization device provided.

The drawback of this process is that the neutralization proves to be reversible, thus leading to the reactivation of the thin antitheft label, in particular as a result of temperature or mechanical stresses.

According to document EP-A-0 123 557, an antitheft influence means is known, presented in the form of a fine thin band of ferromagnetic material. The neutralization of this ferromagnetic marker is made possible by attaching to the band small sections which can be magnetized. When a magnetic field is applied, the small sections are magnetized and permanently polarize the ferromagnetic band. The marker becomes undetectable to the monitoring device.

This neutralization also has the drawback of being reversible as the magnetization of the small sections in question can decrease in intensity over time and thus allow the ferromagnetic band's activity to reappear.

According to document FR-B-2 623 003, a magnetic marker is also known which can be deactivated by subjecting it to an amplitude and/or frequency field much higher than the amplitude or frequency of the detection field. The effect of this deactivation is to dislocate the borders of the magnetic domains of the marker, which then has a hysteretic characteristic different from that in the active state. This method of neutralization can however be of a reversible nature and, in any event, only relates to magnetic markers having a hysteretic characteristic already established when the marker is designed.

The purpose of the invention is to overcome these drawbacks of a lack of efficiency in known magnetic and mechanical neutralization systems.

SUMMARY OF THE INVENTION

According to the invention, the process for neutralizing an influence means included in an antitheft device, this means being capable of a proximity influence on detector means of the type placed for example at the exit of a store, the antitheft device comprising neutralization means activated by mechanical action, is characterized in that the mechanical action is transmitted from the outside to the inside of the device with the device's integrity maintained when the influence means is deactivated.

The neutralization process is thus triggered by an external mechanical action, but this action is transmitted to the inside of the label where the neutralization means operate, without the label's integrity being affected. In particular, the invention avoids the need to resort to removing part of the label. It is therefore not easy for unauthorized persons to know the stages to be implemented in order to deactivate the antitheft device.

The preferred neutralization means used is a substance in the form of a colloidal gel which, in a standby position, is located close to the antitheft influence means. A mechanical action exerted on the antitheft device moves the gel from its standby position to a neutralization position where the gel is dispersed onto the antitheft influence means and therefore alters at least one physical property of the antitheft device.

According to a second aspect of the invention, the process for neutralizing an influence means included in an antitheft device, this means being capable of a proximity influence on detector means placed for example at a store's exit, the antitheft device containing neutralization means which can be activated selectively, is characterized by a first step activating first neutralization means and by keeping on standby a second neutralization means, which is capable of being activated by a mechanical action applied from outside the device towards the inside, the device's integrity being maintained.

The neutralization means by mechanical action thus remains unknown to the purchaser of the article and even to the seller. Both are only aware of the first neutralization means. These persons cannot therefore imagine deactivating the device by deforming it or subjecting it to other mechanical stresses. However, during the article's utilization, mechanical stresses will tend to reactivate the first neutralization means, but will at the same time trigger neutralization by the second neutralization means, which will therefore take over from the first means.

According to a third aspect of the invention, the antitheft device comprising a label integrating an influence means capable of a proximity influence on a detector of the type placed at a store's exit, this device also containing neutralization means for the influence means by mechanical action on the label, is characterized in that the neutralization means are arranged in the label and are responsive to mechanical action transmitted from the outside of the label to the inside, the integrity of the antitheft device being maintained during the neutralization process and once it is completed.

According to a fourth aspect of the invention, it is envisaged to cover the antitheft label at least partially with a protective layer, preferably a silicone-based gel.

According to a last aspect of the invention, the article is characterized in that it comprises an antitheft influence device according to at least one of the third and fourth aspects.

The article is in particular a clothing article or similar, in particular an article that is usually worn and for which it is therefore very inconvenient if the antitheft device reactivates after a period of use.

Other features and advantages of the invention will also emerge from the description below, relating to nonlimitative examples.

DETAILED DESCRIPTION

Figure 1:
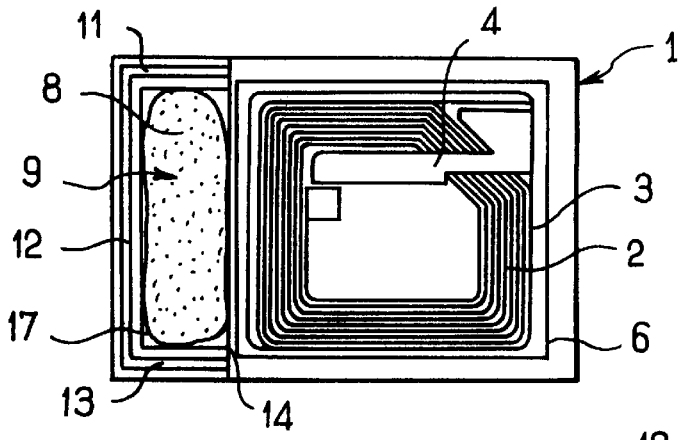
FIG. 1 is a view from above of an antitheft influence label comprising an oscillating coil circuit and means for its selective neutralization.

In the examples illustrated in the drawings, the antitheft device is in the form of a flexible label of a thickness similar to a sheet of paper. This label contains an influence means 2, 4, 22, accommodated for example between a base 41 of the label and a protective sheet 18 of the label.

The influence means can be of the oscillating circuit type including a flat coil 2, with conductive turns in aluminium 3 playing the role of a circuit resonating at a given frequency (of 8.2 megahertz for a size of 4×4 cm). A flat capacitor 4 connects the two ends of the coil. The coil and the capacitor are placed on one face of a slightly larger supporting plastic sheet 6 the other face of which is fixed to the base 41. On its face which is away from the sheet 6, the base 41 is self-adhesive. The antitheft device can thus be stuck to all object packages or objects such as clothing articles 7 to be protected against theft.

According to the invention, the antitheft label 1, 10, 30 can be neutralized by subjecting the label to a mechanical pressure action P causing a substance 8 to be spread onto the coil 2 in order to create electricity-conducting bridges between the turns 3 of the coil 2. A short-circuit of this coil 2 is thus obtained. The circuit will therefore no longer oscillate under the effect of the detection magnetic field emitted by the detection means placed at the stores' exits.

Substance 8, which will produce this short-circuit, is made of an electrically-conductive material.

A colloidal gel having the appearance of glue or gelatine is preferably used as substance 8. This gel used possesses determined rheological properties which are intermediate between the liquid state and the solid state. Using a gel ensures diffusion when the label is pressed and avoids liquid dripping if the label should be pierced.

To be electrically conductive, the gel preferably contains water or a hydrogel in which water is the dispersion medium, made from polymers or mixtures of natural or synthetic polymers which are hydrophilic and swell on contact with water, such as agarose, acrylamide or polyacrylamide-bisacrylamide. The colloidal gel 8 can contain ionic species further improving electrical conductivity.

When the label 1, 10 is manufactured, the gel is placed in a standby position close to but separate from the influence means 2, 3, 4.

The colloidal substance 8 will be transferred from its standby position to an influence means neutralization position by sliding and spreading under the influence of a pressure force P.

In the standby position, the substance 8 is for example placed in a mass between the outer protective sheet 18 and an intermediate sheet 19 separating the gel 8 from the circuit 2, 3, 4. The sheets 18, 19 defining between them a pocket next to the circuit 2, 3, 4. The colloidal gel 8 is thus kept at a constant humidity with no possibility of it drying out. One or more orifices 21 are pierced at some distance from the pocket, in the intermediate sheet 19 placed directly against the turns 3 so that the gel 8 can diffuse.

Figure 2:
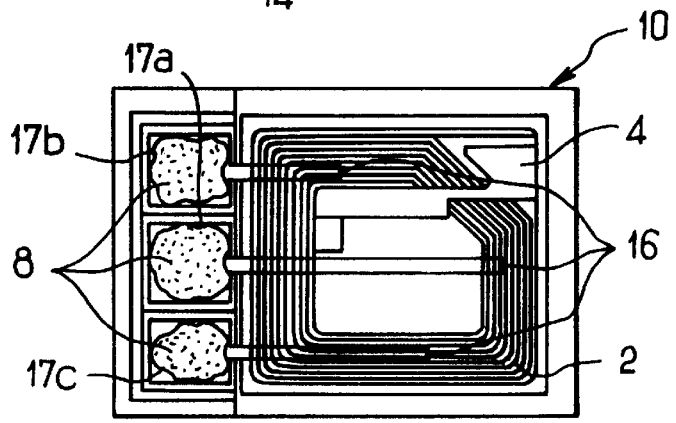
FIG. 2 is a view similar to FIG. 1 but relating to a variant of the neutralization means.

For the reserve of substance 8 in standby position, a pocket 17 or several pockets 17*a*, 17*b*, 17*c* sealed along four edges 11, 12, 13 and 14 can also be created next to the circuit 2, 3, 4, with reference to FIG. 2. The edge 14 situated alongside circuit 2, 3, 4 is sealed by a weaker line of resistance so that the substance 8 can be released by this edge 14 directly onto the flat coil 2.

In the example of FIG. 2, in order to further facilitate dispersion of the gel 8, plastic tubes 16 with a very small section are provided starting from the reserve pockets 17*a*, 17*b*, 17*c*. They are directed towards the centre of the antitheft influence label 10 and open out towards the middle of the label 10 or towards the area of the turns 3, which is located away from the reserve pockets 17*a*, 17*b*, 17*c*. The gel 8 will thus diffuse over the whole flat coil surface.

Figure 3:
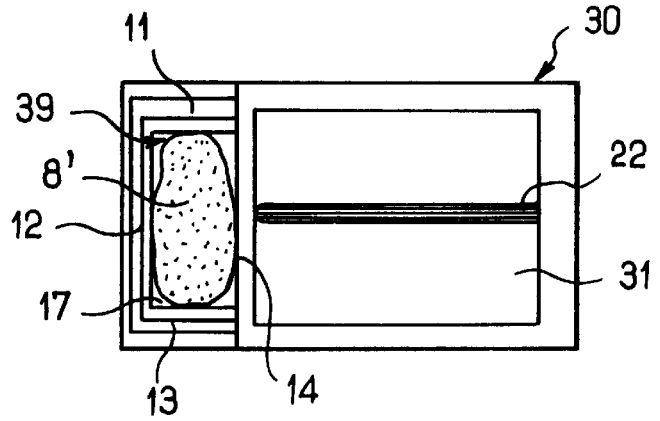
FIG. 3 is a view similar to FIG. 1 but where the influence means is of the ferromagnetic band type.
Figure 4:
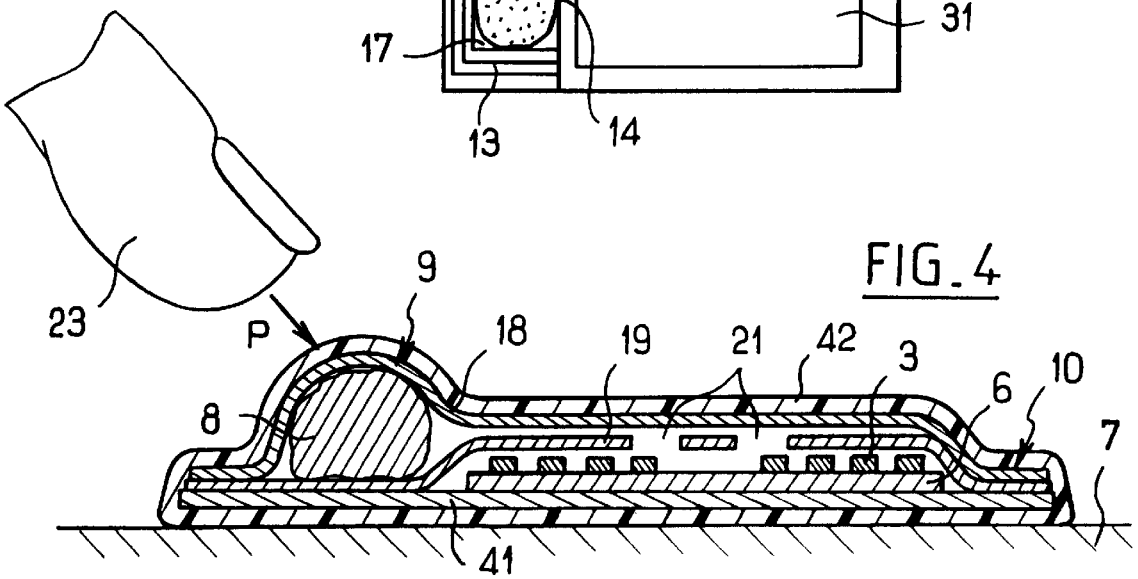
FIG. 4 is a cross-sectional view of an antitheft label according to FIG. 1 but reinforced by a protective layer and simplified as regards neutralization means.

In the example of FIG. 3, the influence means is of a ferromagnetic band type. It then comprises a thin strip 22 of amorphous ferromagnetic material arranged on one face of a support sheet 31 made of a plastic material, the other face of which is fixed to the base 41.

This type of antitheft label 30 is neutralized, as in the case of the resonating circuit labels, by means of a colloidal substance 8', placed in reserve means 39 and diffused by more or less perfected means completely similar to those described above.

Only the composition of the colloidal substance 8' changes. The ferromagnetic band 22 is composed of a soft material which influences the magnetic field sensor of the store's gate. The substance used to neutralize the ferromagnetic band is chosen to ensure, on release, a permanent polarization of the band, which will render it insensitive to the detector field.

To achieve this, a small quantity of hard magnetically remanent material powder is mixed with the colloidal gel 8'. After diffusion of the gel 8' above the band 22, the band becomes insensitive to any external physical stress. The material or the hard remanent material mixture has a coercivity such that remagnetization is not possible with the magnetic fields usually generated.

Powdered materials of the $Fe_2O_3$ ferrite, or Samarium-Cobalt $Sm_2Co_5$ or $Sm_2Co_7$ type are suitable.

Another means of neutralization consists in providing a compound which degrades the ferromagnetic band 22 in the composition of the colloidal gel 8'. Even at a low concentration, the compound will attack the band 22, which triggers a recrystallization nucleus of the amorphous ferromagnetic material.

The compound will also act by degrading the surface of the ferromagnetic band. As the properties of the band depend on an optimum ratio between the length and the square root of the area of the transverse section of the band, alteration by scouring will result in the neutralization of the band.

This will be sufficient to entail the irreversible loss of the magnetic characteristics of the magnetic material.

A strong acid such as nitric acid or hydrofluoric acid is suitable. Mechanical action allows it to be diffused above the band 22 in the same manner and using the same processes as those described above.

Thus, whatever the type of antitheft influence means used, the neutralization can be carried out by provoking, by means of mechanical action applied to the outside of the label and transferred inside it, the spreading of a substance with particular properties, thereby to closely associate the substance with the influence means.

More specifically, the mechanical pressure action P, causing spreading of the substance on the influence means and annihilation of its effects, can be applied deliberately using a finger 23. But in particular in the case of clothing or similar articles, this pressure may be applied unknowingly by the consumer after making the purchase on handling the object in question or on washing or ironing it. Any reactivation will therefore be impossible, as the neutralization by mechanical action will be permanent.

It is advantageous for the new neutralization means to combine with known neutralization means, which can for example result in the application to the antitheft device operating by radiofrequency of a field, the high intensity of which neutralizes the influence means by damaging the oscillating circuit or a specific part of it, intentionally rendered fragile during manufacture. Therefore, at the store's exit, the cashier deactivates the device by the traditional means just indicated, without applying the mechanical action such as P. It is known that this traditional deactivation has the drawback of being reversible, in particular if the device is subjected to strenuous handling during washing or ironing or during use. But thanks to the invention, these types of handling also correspond to a mechanical action triggering the deactivation according to the invention, for example by dispersion of the substance 8 or 8' with reference to FIGS. 1 to 3. The neutralization according to the invention then replaces standard neutralization. This double neutralization process staggered over time has the advantage that the mechanically triggered neutralization according to the invention remains totally unknown to members of the public as they do not see sales staff or cashiers carry out the mechanical action. Even shopkeepers, sales staff or cashiers may be unaware that the antitheft device is equipped with this delayed deactivation means.

Furthermore, certain clothing articles are subjected to strenuous treatment during manufacture, at a stage between assembly and sale. This may for example be washing, ironing, steam pressing or in particular stone washing, which is used to discolour certain articles such as those in denim fabric. These treatments risk, on the one hand, damaging the influence means of the antitheft device and on the other hand activating the neutralization means by mechanical action according to the invention, when this is provided.

In order to overcome this drawback, the antitheft device can be attached after the said treatments, but this increases manufacturing costs. For this reason, it is proposed according to the invention to place on the article, before the treatments, a reinforced antitheft device in order for it to retain a great deal of flexibility but to be less easy to fold to a sharp angle than traditional antitheft labels. For this purpose, for at least one sheet of the label, a material of elastomer or similar type, which may be of a certain thickness without being rigid, can be used. However, it has been found according to the invention that it was sufficient to add to at least one face of the label a heat-resistant protective layer 42, preferably a lacquer made of silicone material. Such a lacquer, initially in a more or less liquid form, is characterized on drying in that it is elastic, flexible and thin, it resists temperatures of the order of 200° C., it constitutes an insulation layer protecting the rest of the label from the heat, prevents the label from experiencing violent local deformations, absorbs shocks and aids watertightness. It is advantageous to place the lacquer 42 in particular on the side which is to experience the stress, such as ironing. If the device is fixed to the back of a fabric the front of which is to be ironed, it may be necessary to protect the base 41 as shown. The watertightness prevents liquids or burning vapour from penetrating the label.

Certainly the reinforcement of the structure containing the influence means and the neutralization means by mechanical action has the result that a more violent mechanical action is necessary to trigger the neutralization process according to the invention. But in the event where the neutralization means by mechanical action is the only one provided, it is still possible for the person who is to neutralize the label to manually fold and/or press the label sufficiently for the deactivation to occur. Only the effort to be applied is increased. In the preferred case where the neutralization means by mechanical action is a subsidiary means intended to compensate for a possible failure in the standard neutralization means, nothing is changed as the improved mechanical and thermal resistance of the label also protects the standard means against unwanted reactivations of the influence means. Simply, a more violent mechanical action is needed on the one hand to return the standard neutralization means to a state where the label is activated and on the other hand to implement the neutralization means according to the invention, which is sensitive to the said mechanical action in order to neutralize the label. Traditional labels age rapidly. The label reinforced or protected by the lacquer ages more slowly. Using this lacquer, the stage where neutralization by mechanical action replaces standard neutralization generally occurs at a later stage during the use of the article by its user.

Of course, the invention is not limited to the examples described and presented.

Several small pockets of colloidal gel can for example be distributed all around the antitheft influence system.

The composition of the gel may be variable, the quantities of compounds present depending on the size of the antitheft influence label to be neutralized.

I claim:

1. A process for neutralizing an influence means included in an antitheft device, said means being capable of a proximity influence on detector means placed at the exit of a controlled area, the antitheft device comprising neutralization means activated by mechanical action, wherein the mechanical action is transmitted from the outside to the inside of the device with the device's integrity maintained when the influence means is deactivated, and wherein by said mechanical action, at least one substance having the property that it eliminates influence phenomenon between the influence device and the detector means is associated with the influence means for neutralization.

2. The process according to claim 1, wherein before the association of the substance with the influence means for the neutralization, said substance is kept directly next to the influence means so that the association can be carried out at any moment via said mechanical action.

3. The process according to claim 1, wherein the substance is associated with the influence means by mechanical pressure action ensuring the transfer of the substance into contact with the influence means starting from a standby position next to the influence means.

4. The process according to claim 1, wherein a colloidal substance is used which may at least partially cover the influence means.

5. The process according to claim 1, wherein the influence means is of the oscillating coil circuit type, and the substance comprises a colloidal substance having the property of short-circuiting the turns of the coil.

6. The process according to claim 5, wherein a hydrogel or a gel in particular containing water is used as the colloidal substance.

7. The process according to claim 1, wherein the influence means is of the magnetic type and the substance comprises a colloidal substance having the property that it polarizes the device.

8. The process according to claim 7, wherein a gel in particular containing a ferromagnetic material is used as the colloidal substance.

9. The process according to claim 1, wherein a colloidal substance is used having the property that it chemically degrades the influence means.

10. The process according to claim 9, wherein a gel with acid properties or a gel containing an acid type compound is used as the colloidal substance.

11. An antitheft device comprising a label in which an influence means is integrated capable of influencing by proximity a detector placed at an exit of a controlled area, said device also containing neutralization means for the influence means operated by mechanical action applied to the label, wherein the neutralization means are arranged in the label and are responsive to mechanical action transmitted from outside the label to the inside, the integrity of the antitheft device being maintained during the neutralization process and once it is completed, and wherein the neutralization means comprise:

(a) at least one substance capable of altering the influence properties of the influence means; and (b) at least one means forming a reserve containing the substance in a standby position precluding said alteration and which is responsive to a mechanical action on the outside of the label thereby to allow the substance to reach an alteration position where it alters the properties of the influence means.

12. The antitheft device according to claim 11, wherein the influence means is an oscillating coil circuit connected to a capacitator, the substance is electrically conductive, and in the alteration position, the substance short-circuits turns of said coil.

13. The antitheft device according to claim 11, wherein the influence means is a magnetic marker and the substance has the property that it polarizes said magnetic marker when it is in the alteration position.

14. The antitheft device according to claim 11, wherein the substance has the property that it chemically degrades said influence means when it is in the alteration position in contact with the magnetic means.

15. The antitheft device according to claim 11, wherein the means forming a reserve comprises at least one pocket containing the substance and is capable under said mechanical action exerted at least indirectly in the form of a pressure on said pocket of releasing said colloidal substance in order to allow it to move to the alteration position next to the influence means.

16. The antitheft influence system according to claim 11, wherein the means forming the reserve comprise at least two layers of a protective material at least one of which is pierced with at least one orifice allowing said substance to move to the alteration position after a mechanical pressure action.

17. The antitheft device according to claim 11, wherein the means forming a reserve for the substance are connected to at least one means forming a conduit for guiding the substance from its standby position to its alteration position after said mechanical action has occurred.

18. The antitheft device according to claim 11, comprising a second neutralization means.

19. An antitheft device comprising a label in which an influence means is integrated capable of influencing by proximity a detector placed at an exit of a controlled area, said device also containing neutralization means for the influence means operated by mechanical action applied to the label, wherein the neutralization means are arranged in the label and are responsive to mechanical action transmitted from outside the label to the inside, the integrity of the antitheft device being maintained during the neutralization process and once it is completed, and wherein the label is at least partially covered with a flexible protective layer having a function selected from at least one of thermal insulation, waterproofing, and shock absorption.

20. The antitheft device according to claim 19, characterized in that the protective layer is made of a lacquer.

21. The antitheft device according to claim 19, characterized in that the protective layer is made of a silicone material.

22. An article having an antitheft device comprising a label in which an influence means is integrated capable of influencing by proximity a detector placed at an exit of a controlled area, this device also containing neutralization means for the influence means operated by mechanical action applied to the label, wherein the neutralization means are arranged in the label and are responsive to mechanical action transmitted from outside the label to the inside, the integrity of the antitheft device being maintained during the neutralization process and once it is completed, and wherein the neutralization means comprise:

(a) at least one substance capable of altering the influence properties of the influence means; and (b) at least one means forming a reserve containing the substance in a standby position precluding said alteration and which is responsive to a mechanical action on the outside of the label thereby to allow the substance to reach an alteration position where it alters the properties of the influence means.

23. The article according to claim 22, wherein said article is a piece of clothing or similar article.

24. An article having an antitheft device comprising a label in which an influence means is integrated capable of influencing by proximity a detector placed near an exit of a controlled area, this device also containing neutralization means for the influence means operated by mechanical action applied to the label, wherein the neutralization means are arranged in the label and are responsive to mechanical action transmitted from outside the label to the inside, the integrity of the antitheft device being maintained during the neutralization process and once it is completed, and wherein the label is at least partially covered with a flexible protective layer having a function selected from at least one of thermal insulation, waterproofing, and shock absorption.

25. The article according to claim 24, wherein said article is a piece of clothing or similar article.

* * * * *